United States Patent [19]

Stewart

[11] Patent Number: 5,062,172

[45] Date of Patent: Nov. 5, 1991

[54] BEDDING MATTRESS SPRING ASSEMBLY HAVING BORDER EDGE SUPPORT

[75] Inventor: Ralph D. Stewart, Carthage, Mo.

[73] Assignee: Leggett & Platt, Incorporated, Carthage, Mo.

[21] Appl. No.: 559,356

[22] Filed: Jul. 30, 1990

[51] Int. Cl.[5] ..... A47C 23/00

[52] U.S. Cl. ..... 5/474; 5/260

[58] Field of Search ..... 5/260, 270, 267, 474; 267/102, 108

[56] References Cited

U.S. PATENT DOCUMENTS

| | | | |
|---|---|---|---|
| 747,002 | 12/1903 | Shaiffer . | |
| 936,649 | 10/1909 | Mauborgne . | |
| 2,008,185 | 7/1935 | Pittoni . | |
| 2,029,076 | 1/1936 | Leeman | 5/474 X |
| 2,709,819 | 6/1955 | Wise | 5/260 |
| 3,082,438 | 3/1963 | Nachman, Jr. . | |
| 3,087,169 | 4/1963 | Melen . | |
| 3,287,744 | 11/1966 | Drews . | |
| 3,305,879 | 2/1967 | Krakauer . | |
| 3,590,404 | 7/1971 | Dreve, Jr. | 5/474 X |
| 3,827,090 | 8/1974 | Roe | 5/474 X |
| 3,945,627 | 3/1976 | Simon . | |
| 4,101,992 | 7/1978 | Levine et al. . | |
| 4,114,210 | 9/1978 | Levine et al. . | |
| 4,326,311 | 4/1982 | Paripovich | 5/260 X |
| 4,577,841 | 3/1986 | Hagemeister . | |
| 4,666,136 | 5/1987 | Hagemeister . | |
| 4,685,659 | 8/1987 | Hagemeister . | |
| 4,721,290 | 1/1988 | Hagemeister . | |
| 4,730,358 | 3/1988 | Zapletal . | |
| 4,796,872 | 1/1989 | Hagemeister . | |

*Primary Examiner*—Michael F. Trettel

*Attorney, Agent, or Firm*—Wood, Herron & Evans

[57] ABSTRACT

A bedding mattress spring assembly comprising rows of coil springs laced together by helical lacing wires and having border wires secured around the periphery of the assembly in the top and bottom planes of the assembly. The border wires are secured to the edgemost coil springs by sheet metal clips. Extending between the border wires are edge support springs which are secured to the border wires by U-shaped channels formed in the ends of the edge support springs.

4 Claims, 3 Drawing Sheets

BEDDING MATTRESS SPRING ASSEMBLY HAVING BORDER EDGE SUPPORT

BACKGROUND OF THE INVENTION

1. Field Of Invention

This invention relates generally to bedding mattresses, and specifically to mattresses having an improved edge support.

2. Description Of Prior Art

Typically, a mattress comprises a spring core or so-called spring assembly covered on the top and bottom sides by a fabric or cushioning pad and encased within an upholstery covering. The spring core generally comprises rows of coil springs laced together in the top and bottom planes of the springs and surrounded by top and bottom border wires. In addition, a mattress may have edge support springs mounted between the border wires to provide additional stiffness or support around the outer edge of the mattress. The present invention is directed to an improved mattress having resilient support in the form of edge support springs around the outer edge of the mattress.

For many years, the most popular technique for securing border wires to spring cores has been to utilize helical lacing wires around the border wires and the points of contact of the border wires with the coil springs. To this border wire equipped spring core, vertical edge support springs extending between the border wires or rods were often added by utilizing the helical lacing wires to secure the ends of the edge support springs to the border rods or by utilizing hog rings to make this connection. But the application of border wires and edge support springs to the spring core by means of helical lacing wires is a labor intensive and relatively expensive operation. Furthermore, helical lacing wire securement of the border rods to the spring core is relatively "loose" so that movement between the border wires and the coil springs within the lacing wire can result in undesirable "noise". In order to reduce the cost of manufacture of the mattress and eliminate the noise problem, the invention of this application utilizes sheet metal clips for securing the border rods to the springs. Substituting sheet metal clips for helical lacing wires reduces the amount of material used in the mattress spring core which results in lower overall material costs. And, substituting sheet metal clips for helical lacing wires results in assembly time savings thereby reducing total overall manufacturing costs and increasing total output and productivity. This assembly technique also reduces or eliminates the noise problem.

The nature of mattress manufacture is that mattress spring cores, or so-called spring assemblies, are generally manufactured in one manufacturing facility and then shipped to a second, and generally much cleaner, manufacturing facility where the cores are covered and upholstered. In the course of upholstering the spring core of the mattress at the second facility, accessories such as border or edge support springs may be added to the spring core so as to differentiate the core from other mattresses manufactured at the same facility. Mattress upholsterers customarily do not have the equipment for feeding and closing sheet metal clips; consequently, these manufacturers, if they wish to add edge support springs to selective units, must use alternative means for connecting the edge support springs to the mattress border wires. According to the practice of this invention, some other means, such as crimpable wire channels formed in opposite ends of the edge support springs are used to connect edge support springs to the border wires.

SUMMARY OF INVENTION

The mattress spring assembly of the present invention comprises a plurality of rows of coil springs, the top and bottom revolutions of which are laced to the top and bottom revolutions of springs in adjacent rows by helical lacing wires. The edgemost coil springs have the outer edges of the top and bottom revolutions secured to top and bottom border wires by means of sheet metal clips. Edge support springs extend between and are connected to the upper and lower border wires by some means other than sheet metal clips, as for example, by crimping channels formed in the ends of the edge support springs around the border wires.

One preferred edge support spring comprises a coiled torsion spring located between the top and bottom border wires and having one end forming an upper arm extending upwardly and outwardly to the upper border wires and the other end forming a lower arm extending downwardly and outwardly to the bottom border wire. The ends of the arms have U-shaped channels formed therein which are crimped over the border wires to secure the edge support springs to the border wires.

A second preferred edge support spring comprises a coiled torsion spring located between the top and bottom border wires and having one end forming an upper arm which extends upwardly and inwardly to the top plane of the spring assembly and then outwardly in the top plane to contact the upper border wire. The other end of the spring forms a lower arm which extends downwardly and inwardly to the bottom plane of the spring assembly and then outwardly in the bottom plane to contact the lower border wires. Both arms have U-shaped channels formed in the ends thereof within which the border wires are received and about which the channels are crimped.

According to the present invention, a new and improved mattress spring assembly may be assembled in minimal time and with minimal material costs while simultaneously permitting the mattress upholsterer who buys the preassembled mattress spring assemblies or cores to add edge support springs to the spring units as desired without the capital expenditures necessary to purchase equipment for feeding and closing sheet metal clips.

BRIEF DESCRIPTION OF THE DRAWINGS

These and other objectives and advantages of this invention will be more apparent from the following description of the drawings in which.

DESCRIPTION OF PREFERRED EMBODIMENTS

Figure 1:
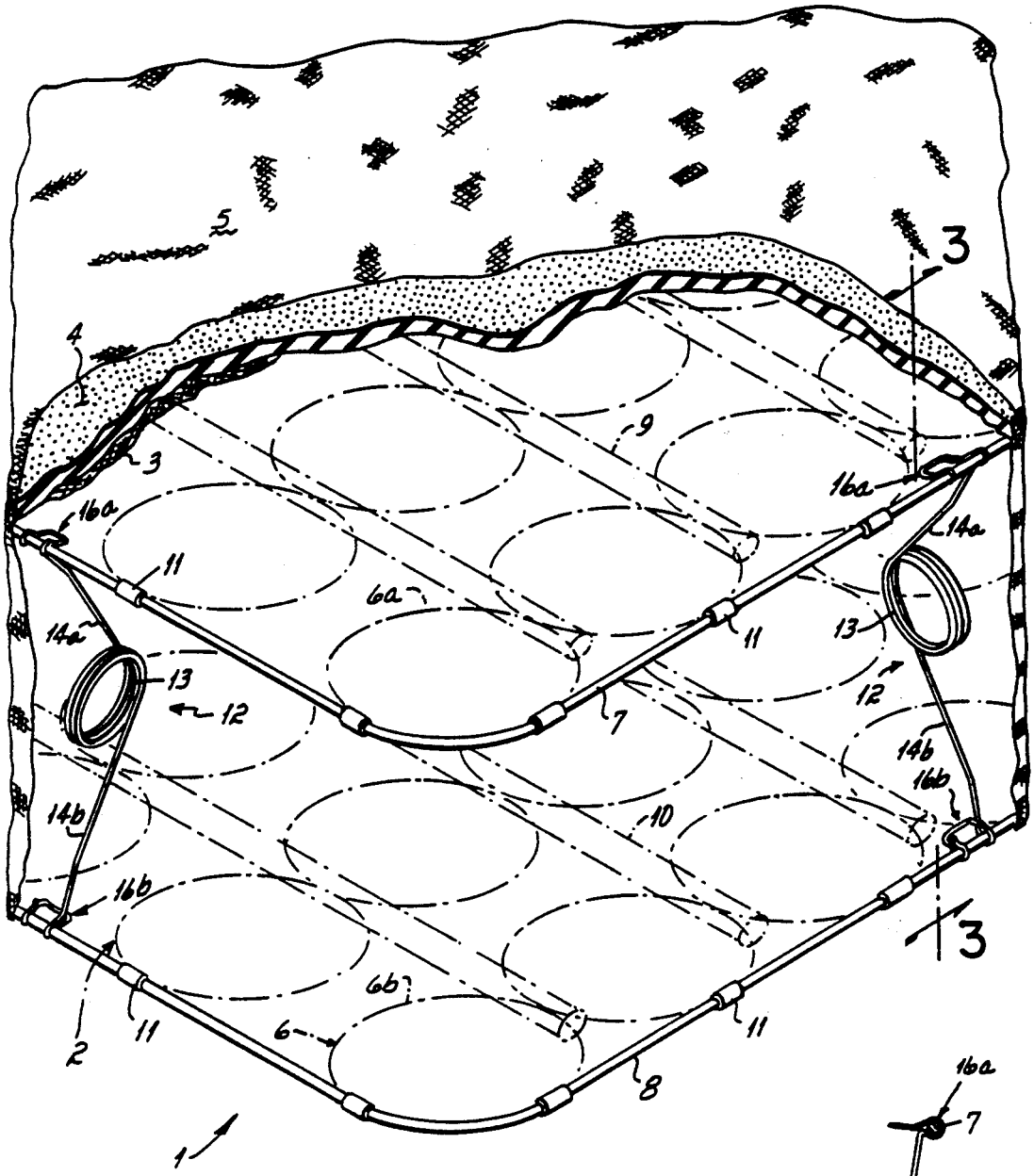
FIG. 1 is a perspective view, partially broken away of a corner portion of an inner spring mattress showing the spring assembly and covering materials.
Figure 3:
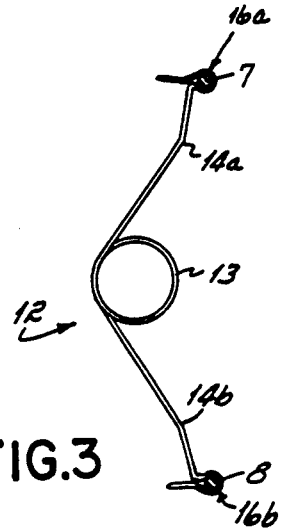
FIG. 3 is a side elevational view of the edge support spring as seen along line 3—3 of FIG. 1.
Figure 2:
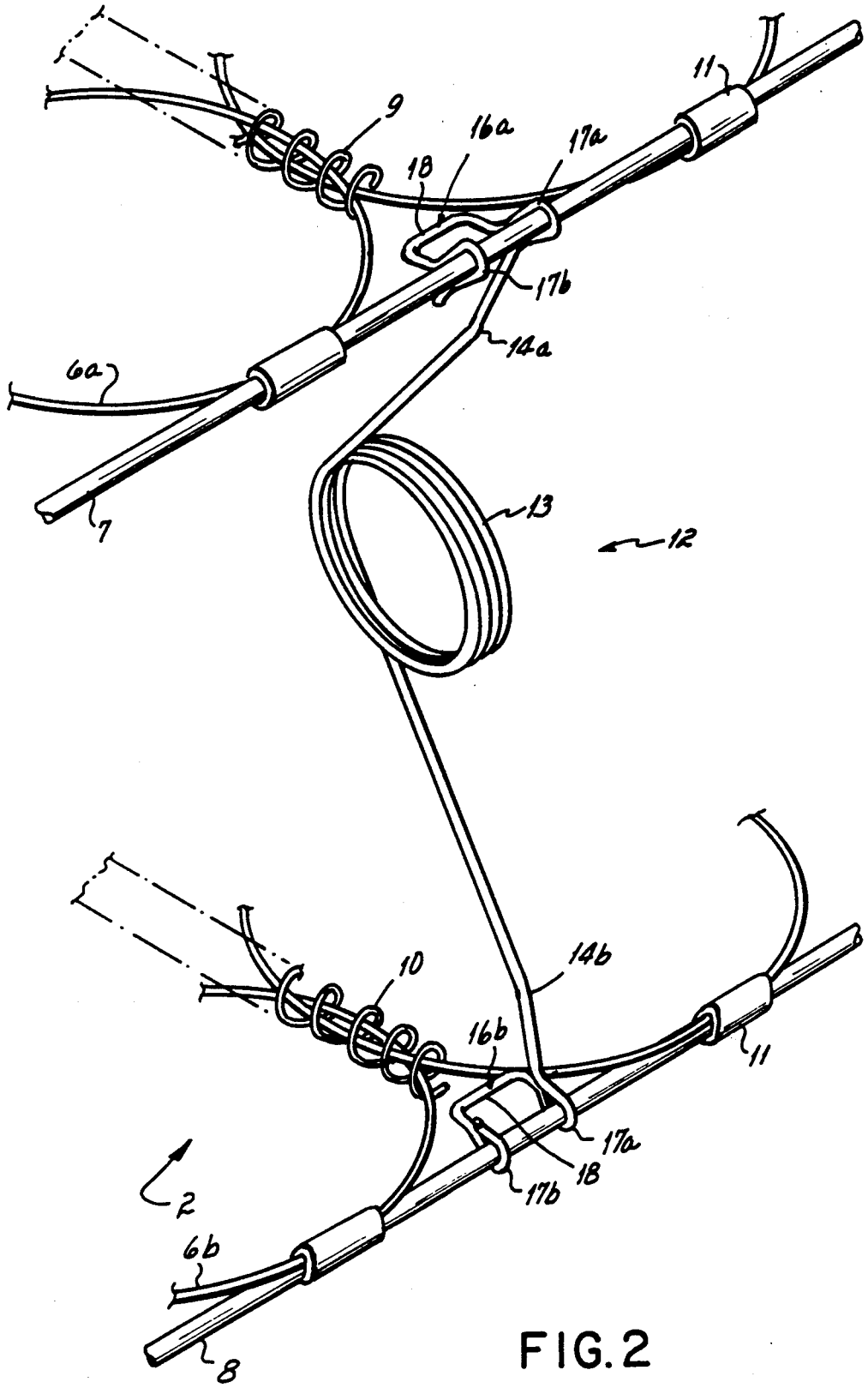
FIG. 2 is an enlarged perspective view of an edge support spring attached to upper and lower border wires of the spring assembly of FIG. 1.

Referring first to FIGS. 1–3, there is illustrated a mattress 1 which comprises a spring assembly or spring core 2, a fabric pad 3 overlying the spring assembly 2, a foam pad 4 overlying the fabric pad 3, and an upholstered covering 5 surrounding spring assembly 2, fabric pad 3, and foam pad 4.

The spring assembly 2 comprises a plurality of coil springs 6, an upper border wire 7, and a lower border wire 8. In the spring assembly 2, employed in the construction of the mattress 1, the upper border wire 7 and lower border wire 8 are substantially rectangular and are spaced apart via the coil springs 6. The coil springs 6, are oriented such that the uppermost coil or revolution **6*a* of each coil spring is coplanar with the upper border wire 7, and such that the lowermost coil or revolution 6*b* of each coil spring is coplanar with the lower border wire 8. The coil springs 6 are bound together in rows with the uppermost coils or convolutions 6*a* of adjacent rows of springs secured together by helical lacing wires 9, and the lowermost coils or convolutions 6*b* of adjacent rows of springs secured together by helical lacing wires 10. The edgemost or peripheral helical springs are attached to the upper border wire 7 and lower border wire 8 by means of sheet metal clips 11, wherein the uppermost convolution 6*a* of a peripheral coil spring is attached to the upper border wire 7, and the lowermost convolution 6*b* of a peripheral coil spring is attached to the lower border wire 8**.

Edge support springs 12 may be spaced around the periphery of a spring assembly 2 as desired. Each edge support spring 12 comprises a coiled torsion spring portion 13 having one or more helical turns or revolutions as desired. From the coiled torsion spring portion 13, two spring arms **14*a*, 14*b* extend outwardly into contact with the border wires 7 and 8, respectively. The arm 14*a* extends upwardly and outwardly to terminate in a U-shaped channel 16*a* and the other spring arm 14*b* extends outwardly and downwardly to terminate in a U-shaped channel 16*b*. Each U-shaped channel 16*a*, 16*b* comprises two inwardly open U-shaped sections 17*a*, 17*b* interconnected by a connector section 18. The U-shaped sections are initially open when the channels are placed over the border wires 7, 8 and are then crimped shut after positioning of the channels over the border wires. A conventional pair of pliers may be used to crimp the U-shaped sections 16*a*, 16*b*** closed.

Figure 4:
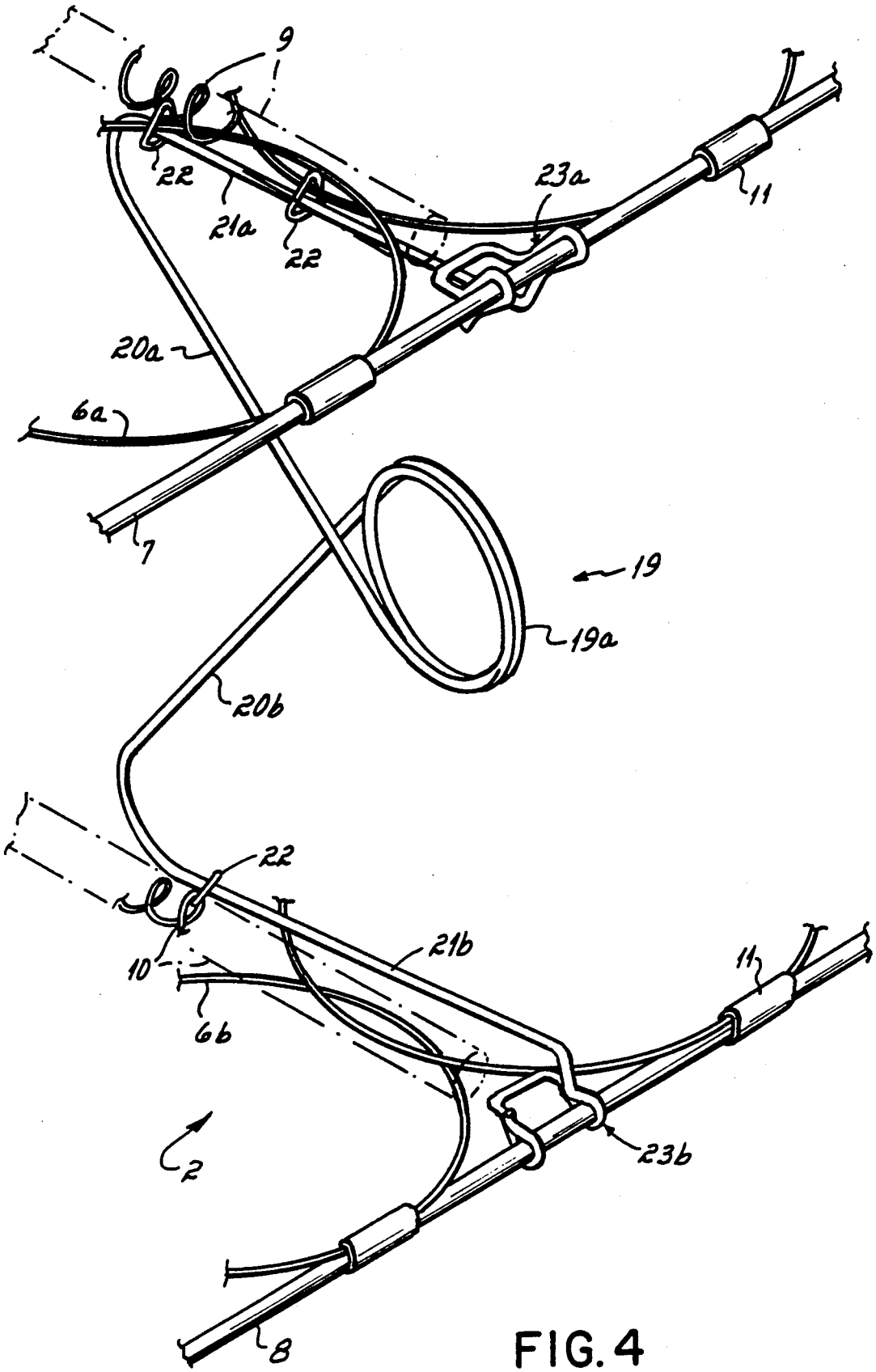
FIG. 4 is a perspective view of a second embodiment of edge support spring utilized in the practice of the invention of this application.

The edge support springs useful in the practice of this invention are not limited to the embodiment illustrated in FIGS. 1–3. Should a manufacturer desire mattress stiffness not only at the outer edge of the mattress but also spaced slightly inwardly from the mattress edge, an alternative edge support spring 19 (FIG. 4) may be utilized. This alternative edge support spring 19 is formed from a single strand of wire and comprises a central coiled torsion spring portion **19*a* from which there extend a pair of arms 20*a*, 20*b*. One of these arms 20*a* extends upwardly and inwardly from the bottom of the coiled torsion spring portion 19*a* to the top plane of the spring assembly and then extends outwardly as at 21*a* in the top plane to contact the upper border wire 7. The other arm 20*b* extends downwardly and inwardly from the top of the coiled torsion spring portion 19*a* to the bottom plane of the spring assembly and then extends outwardly as at 21*b* in the bottom plane to contact the bottom torsion wire. At the ends, both arms have U-shaped channels 23*a*, 23*b* formed therein identical to the channels 16*a*, 16*b* of the edge support spring 12 of the first embodiment. These channels fit over the border wires and are crimped shut in exactly the same manner as the edge support spring 12 is connected to the border wires of the first embodiment illustrated in FIGS. 1–3. Additionally, the outward extensions 21*a*, 21*b* of the arms 20*a*, 20*b* are secured to the lacing wires 9, 10 and the top and bottom convolutions of the coil springs by conventional hog rings 22**.

While I have described only two embodiments of my invention, persons skilled in the art to which it pertains will appreciate numerous changes and modifications which may be made without departing from the spirit of this invention.

I claim:

1. A spring assembly for use in a bedding mattress, said spring assembly including lower and upper border wires, each having a substantially rectangular shape with two sides and two ends, said upper and lower border wires being parallel to one another, a plurality of rows of coil springs extending between said sides of said lower and upper border wires, each of said coil springs in said row being vertically oriented so a lowermost coil revolution of each coil spring is coplanar with said lower border wire and an uppermost coil revolution of each coil spring is coplanar with said upper border wire, endmost coil springs of said rows being located adjacent said lower and upper border wires and having the lowermost coil revolution joined to said lower border wire by a sheet metal clip and the uppermost coil revolution joined to said upper border wire by a sheet metal clip, said rows of coil springs having adjacent lowermost and uppermost coil revolutions joined together by a plurality of parallel helical lacing wires, and a plurality of edge support springs mounted between said upper and lower border wires, said edge support springs being secured to said border wires without the use of any sheet metal clips, each of said edge support springs comprising a single strand of wire having two ends and a torsion coil intermediate said ends of said strand of wire, one of said ends of said strand or wire being secured to said upper border wire and the other end of said strand of wire being secured to said lower border wire, each end of said strand of wire having an open U-shaped channel formed therein, said U-shaped channel having two, horizontally oriented, inwardly open, parallel U-shaped sections interconnected by a connecting portion of said single strand of wire, each of said edge support springs being secured to said upper and lower border wires by securement of said upper and lower border wires within said U-shaped channels of said edge support springs.

2. An edge support spring for use in a mattress spring assembly for providing resilient support between a top border wire located in a top plane of the mattress spring assembly and a bottom border wire located in the bottom plane of the spring assembly, said edge support spring comprising a single strand of wire having two ends, a torsion coil and a pair of arms formed in said strand of wire intermediate said ends, one of said ends being adapted to be secured to said upper border wire and the other end being adapted to be secured to the lower border wire, each of said arms terminating in a U-shaped channel formed in said arms and adapted to be received over one of said border wires and secured thereto by crimping shut said U-shaped channel, each of said U-shaped channels having two, horizontally oriented, inwardly open, parallel U-shaped sections interconnected by a connecting portion of said strand of wire.

3. The edge support spring of claim 2 wherein one of said arms extends upwardly and outwardly from said torsion coil and the other arm extends downwardly and outwardly from said torsion coil.

4. An edge support spring for use in a mattress spring assembly for providing resilient support between a top border wire located in a top plane of the mattress spring assembly and a bottom border wire located in the bottom plane of the spring assembly, said edge support spring comprising a single strand of wire having two ends, a torsion coil and a pair of arms formed in said strand of wire intermediate said ends, one of said ends being adapted to be secured to said upper border wire and the other end being adapted to be secured to the lower border wire, each of said arms terminating in a U-shaped channel formed in said arms and adapted to be received over one of said border wires and secured thereto by crimping shut said U-shaped channel, one of said arms being adapted to extend upwardly and inwardly from said torsion coil to the plane of the top surface of said spring assembly and being bent at an acute angle so as to extend outwardly in said top plane to the point of securement to said upper border wire, the other of said arms being adapted to extend downwardly and inwardly from said torsion coil to the plane of the bottom surface of said spring assembly and being bent at an acute angle so as to extend outwardly in said bottom plane to the point of securement with said lower border wire.

* * * * *